US007386141B2

(12) United States Patent
Beimel et al.

(10) Patent No.: US 7,386,141 B2
(45) Date of Patent: Jun. 10, 2008

(54) HEARING DEVICE AND METHOD OF OPERATING A HEARING DEVICE

(75) Inventors: Bernd Beimel, Erlangen (DE); Kristin Rohrseitz, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 356 days.

(21) Appl. No.: 11/001,602

(22) Filed: Dec. 1, 2004

(65) Prior Publication Data

US 2005/0141736 A1 Jun. 30, 2005

(30) Foreign Application Priority Data

Dec. 1, 2003 (DE) ..... 103 56 093

(51) Int. Cl.
*H04R 25/00* (2006.01)

(52) U.S. Cl. ..... 381/313; 381/312; 381/317

(58) Field of Classification Search ..... 381/23.1, 381/312, 313, 314, 317, 320, 321, 323, 91, 381/92, 122, 356–358
See application file for complete search history.

(56) References Cited

U.S. PATENT DOCUMENTS 5,604,812 A * 2/1997 Meyer ..... 381/314
6,198,830 B1 * 3/2001 Holube et al. ..... 381/321
6,751,325 B1 6/2004 Fischer
7,020,296 B2 * 3/2006 Niederdrank ..... 381/315

FOREIGN PATENT DOCUMENTS

DE 197 21 157 A1 11/1998
WO WO 00/19700 4/2000

* cited by examiner

*Primary Examiner*—Huyen Le

(57) ABSTRACT

The interference noise suppression in hearing devices is to be optimized. A hearing device, in particular a hearing aid (HG) is thus proposed, comprising a directional detection device (RM) for detecting a direction from which an audio signal comes in from the sound source (Q), and a signal processing device (VE) for processing the incoming audio signal as a function of the detected direction. An interference classification device (GK) for classifying the audio signal arriving from the sound source (Q) is also processed as a function of the signal class. With the aid of a signal generator (SG) and a receiver (H), a hearing aid wearer can, for example, be informed about the type and direction of the noise, said type and direction of the noise otherwise being so heavily attenuated by the interference noise suppression that the noise is no longer perceivable to said hearing aid wearer.

21 Claims, 1 Drawing Sheet

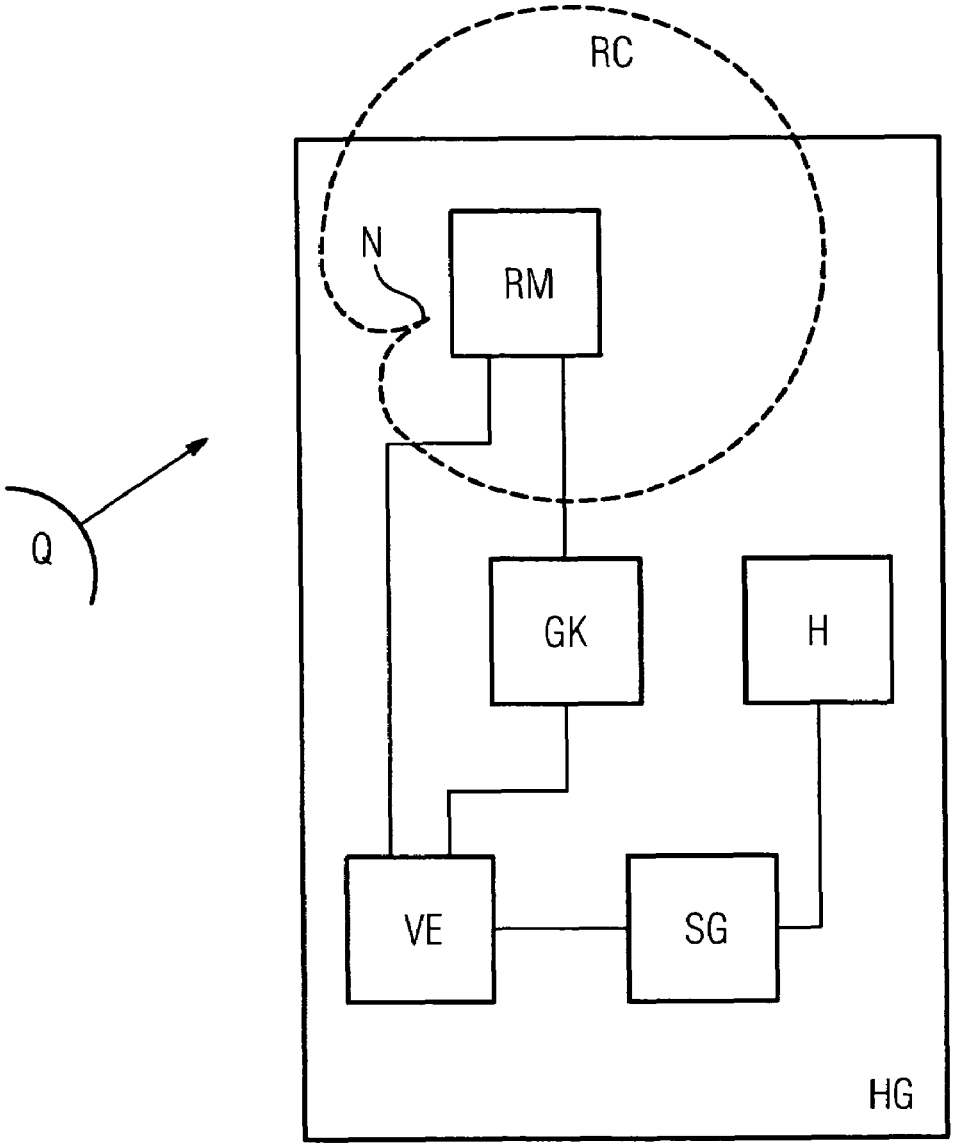
RC
N
RM
Q
GK
H
VE
SG
HG

HEARING DEVICE AND METHOD OF OPERATING A HEARING DEVICE

CROSS REFERENCE TO RELATED APPLICATIONS

This application claims priority to the German application No. 10356093.9, filed Dec. 1, 2003 and which is incorporated by reference herein in its entirety.

FIELD OF INVENTION

The present invention relates to a hearing device with a directional detection device for detecting a direction from which an audio signal from a sound source arrives at the hearing device, and a signal processing device for processing the incoming audio signal as a function of the detected direction. The present invention further relates to a corresponding method for operating a hearing aid of this type.

BACKGROUND OF INVENTION

Hearing aids comprise multiple directional microphones which enable sound to be picked up depending on its direction. It can therefore be useful, for interference noise suppression for instance, to dampen the sound of an interference source as far as possible, said sound being registered in a specific direction. A generic hearing device is known for example from patent specification DE 197 21 157.

Furthermore, patent specification WO 00/19770 discloses a hearing aid, and method for processing microphone signals in a hearing aid, whereby an interference noise suppression is provided in numerous hearing situations. The hearing aid has a signal analyzer which is capable of changing at least one characteristic of the direction-dependent amplification and/or dampening. The signal analyzer carries out a direction analysis of the microphone signals. This enables the strengths of the signal components in the microphone signals to be subdivided into several directional classes.

SUMMARY OF INVENTION

Nevertheless suppressing the noise of a sound source is not a good idea in all situations. It can be dangerous for instance, if a bike or moped rider is approaching a person walking in a wood from behind for the noise to be identified by the hearing aid as interference noise and heavily dampened. The hearing aid wearer might then be shocked to be confronted by an unexpected visual event. Similar dangerous situations can arise for wearers of headphones and headsets.

An object of the present invention is to provide a hearing device, which, for instance, better protects the respective wearer in dangerous situations. Furthermore, a corresponding method for operating a hearing device is to be specified.

This object is achieved by the claims.

The directional detection device in the hearing device preferably comprises an adaptive directional microphone. The directional characteristics of the directional microphone can be adjusted as a function of the signal class for example. Alternatively or in addition, the directional characteristics of the microphone can also be adjusted as a function of the frequency of an incoming audio signal. The one or more indentations and/or notches of the directional microphone characteristics can thus be rotated in a desired direction as a function of the signal class and/or frequency. With predetermined signal classes which signalize a danger for example, the quality of the interference rejection can thereby be correspondingly varied.

The hearing device can comprise a signal output device for outputting a signal about the signal class of the incoming audio signal to the wearer of the hearing device. Similarly, a signal about the direction of the incoming audio signal can be output by this signal output device to the wearer of the hearing aid. The outputted signal can be a voice signal, or a tactile stimulus, e.g. a vibration. For example, the voice generated in a hearing aid enables the hearing aid wearer to be provided with support in a dangerous situation in the form of additional information. This additional information can relate, for instance, to the type of the danger source as well as its direction. The integration of a corresponding information provision system into a hearing aid for example has the advantage of presenting a warning loud enough for the relevant situation. This ensures that the information arrives at the user, in contrast to the noise of a bicycle or moped, which would possibly not be amplified to a sufficient degree.

In addition to the aforementioned embodiment of the hearing device as a hearing aid, an embodiment as headphones or a headset is also conceivable in principle. For example it is also possible for the wearer of headphones to be made aware of the cries of a baby.

BRIEF DESCRIPTION OF THE DRAWING

The present invention is now described in more detail with reference to the accompanying drawings, which show a block diagram of hearing aid according to the invention.

The exemplary embodiment described in more detail below illustrates a preferred embodiment of the present invention.

DETAILED DESCRIPTION OF INVENTION

A hearing aid according to the invention comprises a directional microphone RM, as illustrated schematically in the Figure. In the case of binaural supply, this directional microphone RM can be implemented with microphones on both sides. In addition to the acoustic signals, the directional microphone RM also supplies a directional information to a signal processing device VE. This can be used to align the directional characteristics RC of the directional microphone RM in a desired manner, as shown using a broken line in the Figure.

The directional characteristic RC has one or more indentations and/or notches. A notch N is indicated in the Figure. The sensitivity of the directional microphone RM is at its lowest in the spatial direction characterized by the notch N.

Usually the directional characteristic RC of a directional microphone RM is aligned to an interference source. This is done by directing the notch/notches N towards the interference source Q. This rotation of the directional characteristics enables the interference noise from the direction of the interference source Q to be effectively suppressed.

For the sake of simplicity the directional information could be quantized in quadrants. Accordingly for example, the direction of the interference source Q could be described as 'backwards left', according to the present Figure.

The directional microphone RM supplies the recorded audio signal to a noise classifier GK, in preprocessed form if necessary. This divides the received signals into several signal classes. On the basis of this, information can be received about present dangers. By way of example, baby cries, bicycle bells, tram noises etc are also conceivable as signal classes. The recorded audio signals can also be classified solely with regard to their loudness. On the basis of this classification information, the hearing device HD and/or its signal processing device VE can recognize from which direction the danger may be threatening.

If a tram approaches the hearing aid wearer from the left for example, the information about the type of the noise and its direction can be transmitted to a signal generator SG by means of the signal processing device VE. A voice signal regarding the interference signal source Q is generated by means of a known algorithm. This voice signal is routed to the receiver H of the hearing aid at a sufficient volume. This ensures that the hearing aid wearer receives the information about the interference signal source Q on an acoustic path.

Alternatively or in addition, the signal generator SG can also control a vibrator integrated in the hearing aid HD, if the signal of a specified signal class, e.g. bicycle bell, exceeds a specified predetermined threshold or is becomes louder as the bicycle approaches.

The signals from the hearing aid HG can also be output over other paths. It is thus conceivable that the hearing aid HG transmits the acquired information regarding the direction and type of the noise to a mobile radio telephone, and triggers a corresponding vibration alarm or the like.

An adaptive directional microphone also enables information to be received about the movement of an object. Accordingly a further development of the hearing aid HG according to the invention enables a voice output to be effected through the signal generator SG and the receiver H, by means of which the information about the movement of the object can be output to the hearing aid wearer.

The invention claimed is:

1. A hearing device, comprising:

a detecting device for identifying a direction from which an audio signal originates from a sound source relative to the hearing device;

a sound classification device for classifying the audio signal into a predetermined signal class presenting a danger to a user of the hearing device; and a signal processing device for processing the classified audio signal using the identified direction and the signal class based on a correspondingly varied interference rejection of the signal class for providing the user a warning for the danger.

2. The hearing device according to claim 1, wherein the detecting device comprises an adaptive directional microphone.

3. The hearing device according to claim 2, wherein a directional characteristic of the directional microphone is adjustable using the signal class.

4. The hearing device according to claim 2, wherein a directional characteristic of the directional microphone is adjustable using a frequency of the audio signal.

5. The hearing device according to claim 1, further comprising an output device for generating and outputting an output signal to the user of the hearing device.

6. The hearing device according to claim 5, wherein the output signal includes information related to the signal class.

7. The hearing device according to claim 5, wherein the output signal includes information related to the identified direction.

8. The hearing device according to claim 5, wherein the output device includes a first output element for generating a voice output related to the output signal.

9. The hearing device according to claim 5, wherein the output device includes a second output element for generating and outputting tactile stimuli to the user.

10. The hearing device according to claim 1, wherein the hearing device is configured as a device selected from the group consisting of a hearing aid, a headphone and a headset.

11. The hearing device according to claim 1, wherein the signal class presents a physical danger to a user of the hearing device and is selected from the group consisting of: baby cry, bicycle bell, and tram noise.

12. The hearing device according to claim 1, wherein the signal class presenting the danger to the user of the hearing device is not identified as an interference noise and not dampened.

13. A method of operating a hearing device, comprising:

identifying a direction from which an audio signal originates from a sound source relative to the hearing device;

classifying the audio signal into a predetermined signal class presenting a danger to a user of the hearing device; and processing the classified audio signal using the identified direction and the signal class based on a correspondingly varied interference rejection of the signal class for providing the user a warning for the danger.

14. The method according to claim 13, wherein a directional characteristic of a directional microphone is adjusted using the signal class.

15. The method according to claim 13, wherein a directional characteristic of a directional microphone is adjusted using a frequency of the audio signal.

16. The method according to claim 13, further comprising outputting the processed classified audio signal as an output signal to the user of the hearing device.

17. The method according to claim 16, wherein the output signal includes information related to the signal class.

18. The method according claim 16, wherein the output signal includes information related to the identified direction.

19. The method according to claim 16, wherein the output signal includes a voice output.

20. The method according to claim 16, wherein the output signal includes a tactile stimulus.

21. The method according to claim 13, wherein the signal class presents a physical danger to a user of the hearing device and is selected from the group consisting of: baby cry, bicycle bell, and tram noise.

* * * * *